US006976276B2

(12) United States Patent
Corbitt, Jr.

(10) Patent No.: US 6,976,276 B2
(45) Date of Patent: Dec. 20, 2005

(54) CAROTID COOLING JACKET

(76) Inventor: John D. Corbitt, Jr., 142 JFK Dr., Atlantis, FL (US) 33462

( * ) Notice: Subject to any disclaimer, the term of this patent is extended or adjusted under 35 U.S.C. 154(b) by 223 days.

(21) Appl. No.: 10/309,177

(22) Filed: Dec. 4, 2002

(65) Prior Publication Data

US 2003/0101503 A1 Jun. 5, 2003

Related U.S. Application Data

(60) Provisional application No. 60/334,936, filed on Dec. 4, 2001.

(51) Int. Cl.[7] ..... A62B 17/00
(52) U.S. Cl. ..... 2/458; 62/259.3
(58) Field of Search ..... 2/102, 458, 272, 2/108, 87, 97, 69; 62/259.3, 530; 165/46; 607/108, 112, 114

(56) References Cited

U.S. PATENT DOCUMENTS

| | | | | |
|---|---|---|---|---|
| 4,033,354 | A * | 7/1977 | De Rosa | 607/108 |
| 4,628,932 | A * | 12/1986 | Tampa | 607/108 |
| 5,146,625 | A | 9/1992 | Steele et al. | |
| 5,755,110 | A | 5/1998 | Silvas | |
| 6,152,952 | A | 11/2000 | Owens | |
| 6,349,412 | B1 | 2/2002 | Dean | |

* cited by examiner

*Primary Examiner*—Tejash Patel
(74) *Attorney, Agent, or Firm*—Dickstein Shapiro Morin & Oshinsky LLP

(57) ABSTRACT

A carotid cooling jacket keeps the wearer cool during outside sporting events, for example. The jacket is reusable, and constructed of a waterproof inner lining and a soft outer cover. The outer cover can be made of various materials and in various colors. Filler caps are provided to fill the jacket inner liner with cooling fluid.

11 Claims, 3 Drawing Sheets

2
10
Filler Caps
4
4

CAROTID COOLING JACKET

This application claims the benefit of U.S. Provisional Application Ser. No. 60/334,936, filed Dec. 4, 2001.

BACKGROUND OF THE INVENTION

1. Field of the Invention

The present invention relates to a cooling garment, particularly a wearable jacket containing ice for cooling the wearer.

2. Brief Description of the Related Art

The carotid artery supplies blood to the head and neck. The left common carotid artery branches directly off the aortic arch. The right common carotid artery branches off the brachiocephalic artery. Cooling the blood flowing through the carotid could be vital to providing comfort to individuals experiencing excessive over heating endured as the result of environmental or physiological conditions.

Many environmental and physiologic conditions cause elevated body temperatures. Such conditions can cause discomfort and dehydration, nausea, dizziness, and fainting spells, among other unhealthy physical signs and potentially dangerous symptoms. A variety of industries and climates inflict uncomfortably and, at times, intolerably high temperatures upon persons. For example, heat sources in nuclear plants and foundries produce heat capable of driving temperatures in such plants up to 120 degrees Fahrenheit or more. Conditions resulting from heat stress in such environments can increase risk of significant mistakes in judgment, absenteeism, and down time. Weather conditions experienced while engaged in outdoor activities similarly can have a deleterious biophysical effect.

In addition, many physiological disorders and conditions are accompanied by elevations of body temperature, some of which include multiple sclerosis, trauma patients suffering injury to the spinal cord or brain, and patients with burns, various local, regional or systemic viral or bacterial infections, and other physiological disorders and condition which can benefit from therapeutic cooling. Further, workers in many industries are required to wear layers of protective clothing to protect against pollutants such as asbestos fibers and radiologic contamination in nuclear plants, which may cause elevation of temperatures and loss of body fluids.

Various garments for cooling the body are known in the prior art. U.S. Pat. No. 5,146,625 to Steele et al., for example, discloses a wearable vest having front and back torso-covering panels with pockets that receive gel cooling packs. The front and back panels undesirably add weight to the garment, and the vest does not extend upward toward or around the neck, so that cooling of the carotids and neck is not maximized. Further, the vest is limited to using self-contained, gel cooling packs, and hence is not readily rechargeable once the cooling packs have warmed to ambient temperature.

Accordingly, an easily wearable, reusable garment is needed that provides cooling to the area of the carotid arteries, and that can be readily recharged with coolant by the user.

SUMMARY OF THE INVENTION

The present invention provides a reusable carotid cooling jacket that is easily wearable and rechargeable, and keeps the wearer cool. The jacket is worn on the front of the torso, and provides cooling surfaces to the areas of the carotid arteries. The jacket preferably includes a liner constructed of a flexible, waterproof material, which is insulated by a soft outer cover. The outer cover can be made of various materials and in various colors. Filler caps are provided to fill the jacket inner liner with cooling fluid or ice.

According to a preferred embodiment, the jacket is filled by way of the filler caps with water or other coolant. The jacket and its contents can be frozen or cooled, in a freezer, for example. The jacket and its frozen or cooled contents then are worn to keep the wearer comfortable in conditions of excessive heat or for therapeutic purposes. The jacket can be recharged easily by replacing melted ice with crushed or cubed ice.

Other features and advantages of the present invention will become apparent from the following description of the invention which refers to the accompanying drawings.

DETAILED DESCRIPTION OF THE EMBODIMENTS OF THE INVENTION

Figure 1:
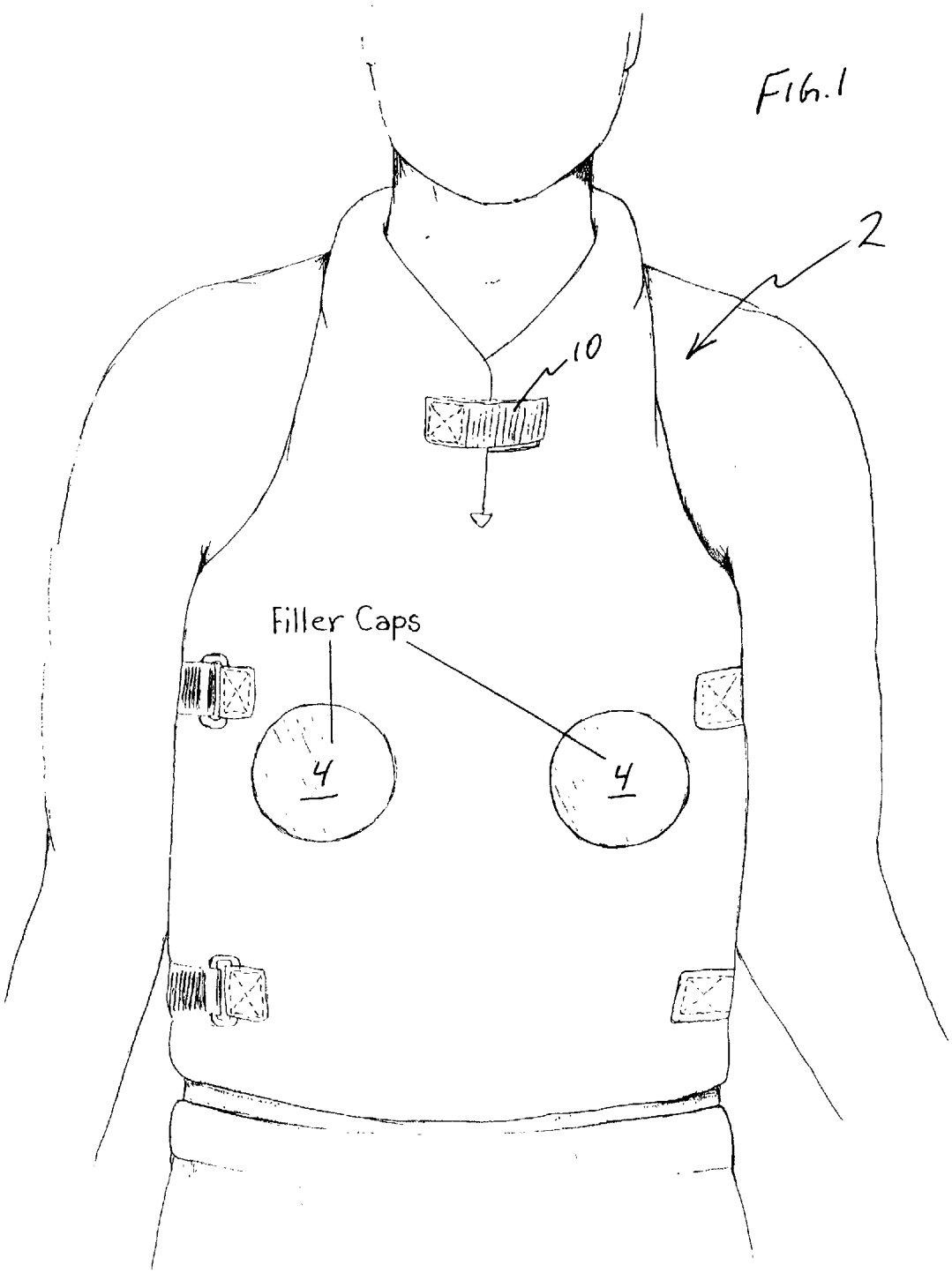
FIG. 1 is a front view of a cooling jacket being worn according to a preferred embodiment of the present invention.
Figure 2:
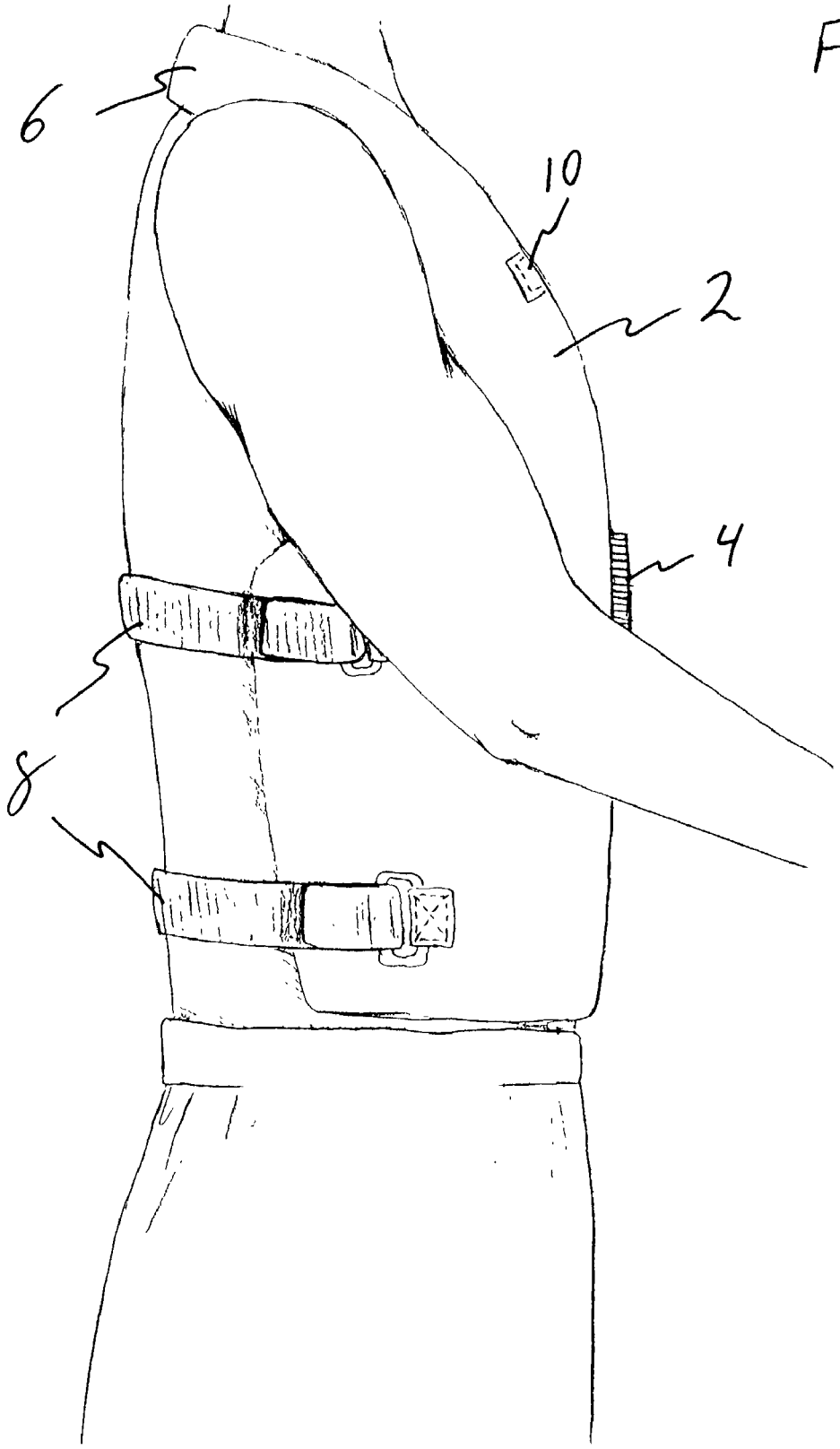
FIG. 2 is a side view of the cooling jacket of FIG. 1.
Figure 3:
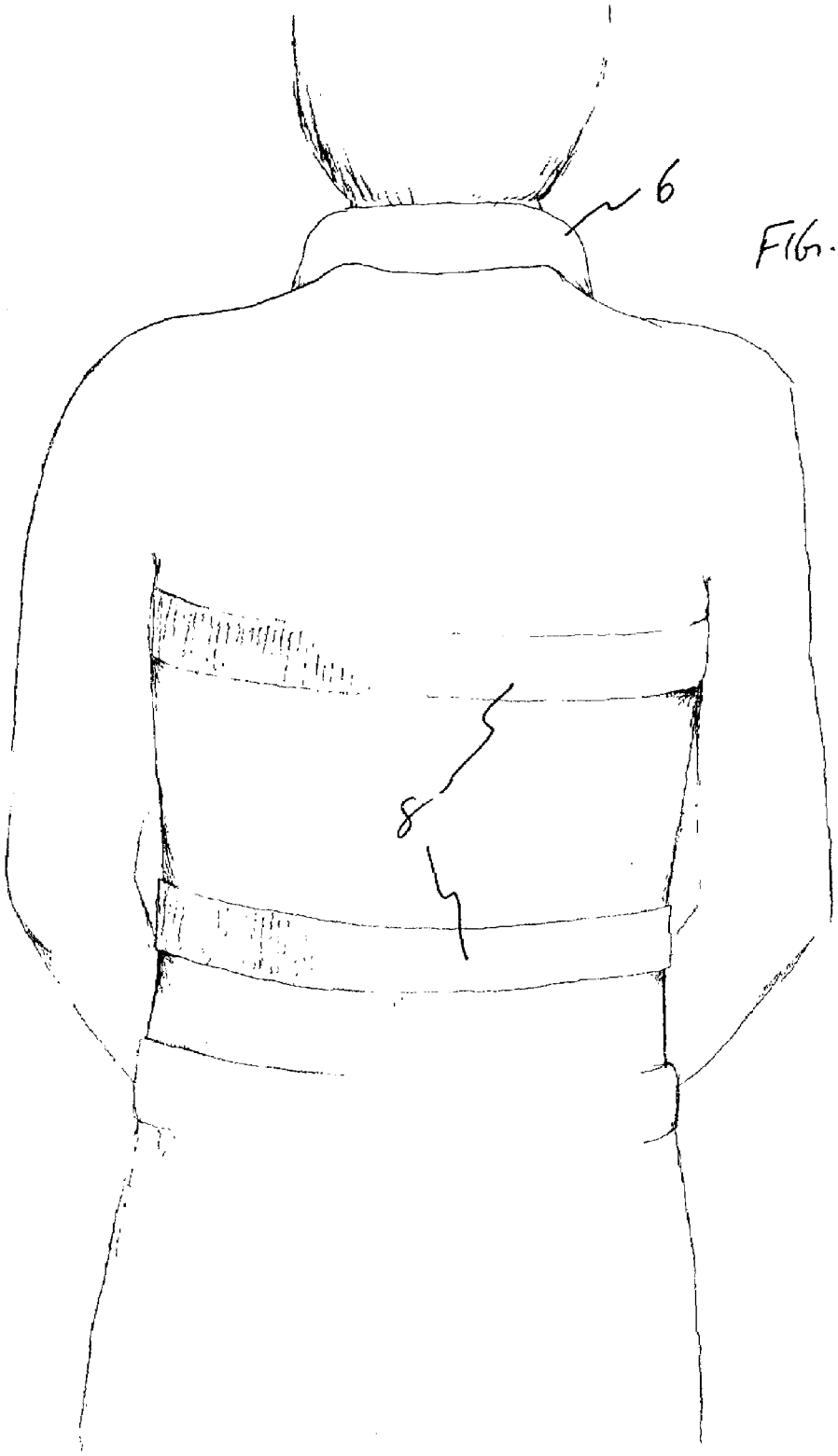
FIG. 3 is a rear view of the cooling jacket of FIG. 1.

Referring initially to FIG. 1, a carotid cooling jacket 2 according to the present invention is shown. Jacket 2 is constructed of a flexible waterproof liner. The liner is arranged as a liquid container for a coolant that can be frozen or chilled to keep the wearer cool. A cover constructed from a soft material such as cotton is provided over the liner for the comfort of the wearer. In addition, the cover preferably is insulated to protect the coolant enclosed within the liner from ambient conditions and the user's body heat.

In this regard an insulation layer (not shown) extends about the entire jacket to reduce heat transfer to the liner from ambient air and the user. A preferred insulation layer contains a laminate operating by means of reflection from the metallic film. The layer of insulation on the inside surface of the jacket, adjacent the user's torso, prevents excessive initial cooling of the wearer, such that a more even cooling effect is provided over a longer period of time.

The jacket substantially covers the front of the wearer's torso. A portion of the jacket 6 loops around the wearer's neck. Preferably, the neck loop portion also contains a continuation of the inner liner, thereby providing cooling to the front of the shoulders and the back of the neck. A portion of the jacket rests on the front of the patient's upper chest and neck to provide cooling to the area of the carotid arteries.

The jacket is shown in a sleeveless style for ease of wearing over or under other garments. Alternatively, short or long sleeves could be added to the garment, for example. The outer cover can be provided in various colors or with insignia as befits the intended use of the jacket.

The jacket is donned over the wearer's head and drapes along the front of the wearer. Fabric straps 8 are provided to secure the jacket in place on the wearer. Additional strapping 10 can be provided to adjust the neck opening. The straps can be held in place using hook and loop fasteners. Other fastenings could be used, as are known in the art.

The jacket is filled with coolant through filler caps 4. Filler caps 4 are removed to provide access inside the jacket liner. The filler caps can utilize various known water-tight closure mechanisms, including screw threads, snap fit, friction plugs, etc. Once the jacket has been filled with ice or another coolant, the filler caps are replaced and the jacket is ready either for freezing or immediate use, depending on the coolant employed.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed as new and desired to be protected by Letters Patent of the United States is:

1. A cooling vest comprising:

an open-backed fluid-fillable liner arranged and configured to be hung around a user's neck to substantially cover the front of a user's torso;

at least one connector extending around the back of the user's torso to releasably secure the liner; and at least one recloseable opening providing access into the liner for refilling the liner with coolant.

2. The cooling vest of claim 1, wherein the coolant is water.

3. The cooling vest of claim 2, wherein the water is frozen.

4. The cooling vest of claim 1, wherein the fluid-fillable liner extends around the user's neck.

5. The cooling vest of claim 1, further comprising an insulative cover surrounding the liner.

6. A method of cooling a human using an open-backed carotid cooling jacket including a fluid fillable liner, the method comprising the steps of:

removing at least one filler cap to access a respective opening to the inside of the liner;

filling the liner through the opening with a liquid;

replacing the filler cap;

freezing the liquid inside the liner; and wearing the jacket, the jacket hanging around the neck of the user and covering substantially only the front of the user's torso.

7. The method of claim 6, wherein the liquid is water.

8. The method of claim 7, further comprising the steps of emptying warmed water from the liner, and refilling the liner with crushed or cubed ice.

9. The method of claim 6, wherein the step of wearing the jacket includes donning the jacket over the user's head.

10. The method of claim 9, further comprising the step of securing the jacket to the torso with at least one strap removably attached to the jacket and provided around the back of the user's torso.

11. The cooling vest of claim 1, wherein the liner is waterproof.

* * * * *